US006333131B1

(12) United States Patent
Ishiyama et al.

(10) Patent No.: US 6,333,131 B1
(45) Date of Patent: Dec. 25, 2001

(54) TONER FOR THE DEVELOPMENT OF ELECTROSTATIC IMAGE, PROCESS FOR THE PREPARATION THEREOF, ELECTROSTATIC IMAGE DEVELOPER, AND PROCESS FOR THE FORMATION OF IMAGE

(75) Inventors: Takao Ishiyama; Manabu Serizawa; Takeshi Shoji; Shuji Sato; Takashi Inukai, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/663,381

(22) Filed: Sep. 15, 2000

(30) Foreign Application Priority Data

Feb. 21, 2000 (JP) ..... 12-042326

(51) Int. Cl.[7] ..... G03G 9/097

(52) U.S. Cl. ..... 430/108.6; 430/108.7; 430/111.4

(58) Field of Search ..... 430/106, 109, 430/110, 111, 108.6, 108.7, 111.4

(56) References Cited

U.S. PATENT DOCUMENTS 5,968,701 * 10/1999 Onuma et al. ..... 430/110
6,040,104 * 3/2000 Nakamura et al. ..... 430/110
6,103,439 * 8/2000 Ogawa et al. ..... 430/110

FOREIGN PATENT DOCUMENTS 59-218459 12/1984 (JP) .
59-218460 12/1984 (JP) .
63-282752 11/1988 (JP) .
4-69666 3/1992 (JP) .
5-61239 3/1993 (JP) .
6-250439 9/1994 (JP) .
9-258481 10/1997 (JP) .

* cited by examiner

*Primary Examiner*—John Goodrow
(74) *Attorney, Agent, or Firm*—Oliff & Berridge, PLC

(57) ABSTRACT

There is provided a toner for the development of an electrostatic image having a complex viscosity $\eta^*$ of from $3.0\times10^2$ to $1.2\times10^3$ Pas at 160° C. and a loss tangent tan $\delta$ of from 0.60 to 1.60 as determined by temperature dispersion measurement method by sinusoidal oscillation method, a method for manufacturing the toner by a coaggregation fusion composite method, developer, and an image forming method.

19 Claims, No Drawings

TONER FOR THE DEVELOPMENT OF ELECTROSTATIC IMAGE, PROCESS FOR THE PREPARATION THEREOF, ELECTROSTATIC IMAGE DEVELOPER, AND PROCESS FOR THE FORMATION OF IMAGE

BACKGROUND OF THE INVENTION

The present invention relates to a toner for the development of an electrostatic image for use in the development of an electrostatic latent image formed by electrophotographic process or electrostatic recording process with a developer, a process for the preparation thereof, an electrostatic image developer, and a process for the formation of an image.

A method for rendering an image data visible via electrostatic image such as electrophotography has been used in various fields. In electrophotography, an electrostatic latent image is formed on a photoreceptor at a charging/exposure step. The electrostatic latent image is developed with a developer containing a toner, and then processed at a transferring step and a fixing step to become visible.

Known examples of the developer to be used in electrophotography include two-component developer comprising a toner and a carrier and one-component developer comprising a magnetic or non-magnetic toner alone. Such a toner is normally prepared by a knead-grinding method which comprises melt-kneading a thermoplastic resin with a pigment, a static controller and a release agent such as wax, cooling the mixture, finely grinding the mixture, and then classifying the particles. In this method, inorganic or organic particles may be attached to the surface of the toner particles to improve the fluidity or cleaning properties of the toner. These methods can produce an extremely excellent toner but has the following some disadvantages.

In the ordinary knead-grinding method, the resulting toner has an indefinite shape and surface structure that closely change with the grindability of the material used or the grinding conditions. Thus, it is difficult to intentionally control the shape and surface structure of the toner. In the ordinary knead-grinding method, the range of selection of material is restricted. In other words, the resin dispersion of colorant must be brittle enough to be finely ground by an economically possible grinding machine. However, when the resin dispersion of colorant is rendered brittle to meet these requirements, the resulting toner can further produce a fine powder or have a change in shape due to mechanical shearing force applied to the toner in the developing machine. For the two-component developer, fine powder is fixed to the surface of carrier to accelerate the deterioration of chargeability of the developer. For the one-component developer, the expansion of particle size distribution causes the toner particles to be scattered. Further, the change in the shape of the toner particles causes a deterioration of developability that can lead to deterioration of image quality.

In the case where a large amount of a release agent is added to prepare a toner, the kind of the thermoplastic resin to be used in combination with the release agent can often affect the exposure of the release agent to the exterior of the toner. In particular, when a slightly less grindable resin having an enhanced elasticity given by the incorporation of a high molecular component and a brittle wax such as polyethylene are combined, the polyethylene is drastically exposed to the exterior of the toner. This is favorable for releasability of fixed image during fixing or removability of untransferred toner from the photoreceptor. However, since the polyethylene in the surface layer can easily migrate when acted upon by mechanical force, the developing roll or photoreceptor can be easily stained with the carrier, resulting in the drop of reliability.

Further, when the shape of the toner particle is indefinite, sufficient fluidity cannot be secured even if provided with a fluidizing aid. Thus, when acted upon by mechanical shearing force during operation, the particles on the surface of the toner migrate into the indentation on the toner, deteriorating the fluidity thereof with time, or become embedded in the interior of the toner, deteriorating the developability, transferability and cleaning properties thereof. Further, when the toner recovered at the cleaning step is returned to the developing machine for reuse, the resulting image quality can be deteriorated even more easily. When a fluidizing aid is added more to prevent these defects, the generation of black peppers on the photoreceptor or scattering of particles of fluidizing aid can easily occur.

In recent years, as a method for controlling the shape or surface structure of the toner particle there has been proposed a method for preparing a toner using emulsion polymerization aggregation as disclosed in the Unexamined Japanese Patent Application Publication No. Sho 63-282752 and the Unexamined Japanese Patent Application Publication No. Hei 6-250439. In accordance with this method, a particulate resin dispersion is usually prepared by emulsion polymerization method or the like. Separately, a colorant dispersion having a colorant dispersed in a solvent is prepared. The two dispersions thus prepared are then mixed to form aggregated particles having a diameter corresponding to that of the desired particulate toner. The dispersion is then heated so that the aggregated particles undergo coalescence to prepare a toner. In this manner, the shape of the toner particles can be controlled to some extent, making it possible to improve the chargeability and durability of the toner. However, since the particulate toner thus prepared has a substantially uniform internal structure, it remains disadvantageous in that the fixed sheet cannot be fairly peeled off at the fixing step and the image outputted on OHP sheet can not be provided with a stable transparency.

Thus, in order that the toner can invariably maintain its properties in electrophotographic process even under various mechanical stresses, it is important to prevent the release agent from being exposed to the exterior of the toner or enhance the surface hardness of the toner with out impairing the fixability thereof as well as enhance the mechanical strength of the toner itself and secure sufficient chargeability and fixability.

Further, there has been a growing demand for the enhancement of image quality in recent years. For the formation of color image in particular, there has been a remarkable tendency for the reduction of diameter of toner particles for the purpose of attaining highly fine image. However, when the diameter of toner particles is reduced leaving the conventional particle size distribution as it is, the presence of fine powder adds to the problem of staining on the carrier or photoreceptor or scattering of toner, making it difficult to attain high image quality and high reliability at the same time. In order to prevent this defect, it is also important to provide a sharp particle size distribution and reduce the particle diameter of toner.

In a digital full-color copying machine or printer, a color image original is subjected to color separation through various filters, i.e., B (blue) filter, R (red) filter and G (green) filter. The resulting latent images made of dots having a diameter of from 20 $\mu$m to 70 $\mu$m corresponding to the original image are then developed utilizing subtractive mixture process with various developers, i.e., Y (yellow), M (magenta), C (cyan) and Bk (black) developers. However, since this process requires that a large amount of developers be transferred and dots having a reduced diameter be coped with as compared with the conventional black-and-white copying machine or printer, it is even more important to secure uniform chargeability, high durability, sufficient toner strength and sharp particle size distribution. Further, taking into account the tendency for the enhancement of operation speed of these machines and the reduction of energy consumption, an even higher low temperature fixability is required. In this respect, too, coalescence process, which is suitable for the production of particulate material having a sharp particle size distribution and a small particle diameter, has been paid attention. For full-color machines, it is important to securely mix a large amount of toners. It is also essential to improve the color reliability of the resulting image and secure high OHP transparency.

On the other hand, as a release agent component for preventing low temperature offset during fixing there is usually incorporated a polyolefin-based wax. Combined with this measure, a slight amount of a silicone oil is uniformly applied to the fixing roller to improve high temperature offset resistance. As a result, the transfer material thus outputted has some of the silicone oil attached thereto, giving uncomfortable sticking during handling.

The Unexamined Japanese Patent Application Publication No. Hei 5-61239 proposes a toner adapted for oilless fixing comprising a large amount of a release agent component incorporated therein. Although the incorporation of a large amount of a release agent gives some improvement of releasability, the binder resin component in the toner and the release agent become compatibilized with each other, making it difficult to secure stable or uniform running of release agent and hence obtain stable peelability. Further, since the cohesive force of the binder resin in the toner depends on the weight-average molecular weight or glass transition temperature of the binder resin, it is difficult to directly control the stringiness and cohesiveness of toner during fixing. Moreover, the free release agent component can cause malcharging.

As approaches for solving these problems there are proposed a method which comprises adding a high molecular component to provide the binder resin with rigidity in the Unexamined Japanese Patent Application Publication No. Hei 4-69666 and the Unexamined Japanese Patent Application Publication No. Hei 9-258481 and a method which comprises introducing chemically crosslinked structure to compensate for the lack of rigidity, thereby reducing the stringiness of toner at the fixing temperature and hence improving peelability during oilless fixing, in the Unexamined Japanese Patent Application Publication No. Sho 59-218460 and the Unexamined Japanese Patent Application Publication No. Sho 59-218459.

As disclosed in the Unexamined Japanese Patent Application Publication No. Sho 59-218460 and the Unexamined Japanese Patent Application Publication No. Sho 59-218459, mere addition of a crosslinking agent to a binder resin causes a rise in the viscosity, i.e., cohesive force of the toner during melting, increasing the rigidity of the binder resin itself and hence making it possible to lessen the temperature dependence of peelability during oilless fixing or carried amount of toner to some extent. However, it is difficult to provide the fixed image with a sufficient surface gloss at the same time. Further, the bending resistance of the fixed image is insufficient. As disclosed in the Unexamined Japanese Patent Application Publication No. Sho 59-218460, when the molecular weight of the crosslinking agent is increased, the molecular weight of the entanglement region increases, enhancing the flexibility of the fixed image itself somewhat. However, it is difficult to balance between elasticity and viscosity properly. As a result, the desired temperature dependence of peelability during oilless fixing and temperature dependence of carried amount of toner and the desired surface gloss of fixed image and OHP transparency can hardly be attained at the same time. In particular, satisfactory fixed image cannot be obtained with energy-saving type fixing device and high printing speed type copying machine or printer.

SUMMARY OF THE INVENTION

It is therefore an object of the present invention to solve the foregoing problems and provide a toner for the development of an electrostatic image which exhibits reduced temperature dependence of peelability during oilless fixing and temperature dependence of carried amount of toner, provides the fixed image with a good gloss, gives excellent adhesivity of fixed image to fixing sheet, peelability of fixed sheet, offset resistance, bending resistance of fixed image and OHP transparency, and high uniformity and stability of chargeability, causes no fog and scattering and allows the formation of high quality image, a process for the preparation thereof, an electrostatic developer and a process for the formation of an image.

The inventors made extensive studies of solution to the foregoing problems. As a result, the inventors succeeded in solving the foregoing problems by employing the following constitutions.

(1) A toner for the development of an electrostatic image having a complex viscosity $\eta^*$ of from $3.0\times10^2$ to $1.2\times10^3$ Pas at 160° C. and a loss tangent tan $\delta$ of from 0.60 to 1.60 as determined by temperature dispersion measurement method by sinusoidal oscillation method.

(2) The toner for the development of an electrostatic image according to Clause (1), comprising an inorganic particulate material having a central particle diameter of from 5 nm to 100 nm incorporated therein in an amount of from 2 to 20% by weight.

(3) The toner for the development of an electrostatic image according to Clause (1) or (2), wherein as the inorganic particulate material there is used one selected from the group consisting of silica, titanium oxide, aluminum oxide, calcium carbonate, magnesium carbonate and tricalcium phosphate.

(4) The toner for the development of an electrostatic image according to any one of Clauses (1) to (3), wherein as the inorganic particulate material dispersion there is used one having one or more selected from the group consisting of silica, titanium oxide, aluminum oxide, calcium carbonate, magnesium carbonate and tricalcium phosphate dispersed in an ionic surfactant, high molecular acid or high molecular base.

(5) The toner for the development of an electrostatic image according to any one of Clauses (1) to (4), comprising a release agent incorporated therein in an amount of from 5 to 25% by weight.

(6) The toner for the development of an electrostatic image according to any one of Clauses (1) to (5), having a volume-average particle diameter $D_{50}$ of from 3 $\mu$m to 9 $\mu$m.

(7) The toner for the development of an electrostatic image according to any one of Clauses (1) to (6), having a volume-average particle size distribution index GSDv of 1.30 or less and a GSDv (volume-average particle size distribution index) /GSDp (number-average particle size distribution index) ratio of 0.95 or more.

(8) The toner for the development of an electrostatic image according to any one of Clauses (1) to (7), wherein the shape factor SF1 of the particulate toner is from 100 to 120.

(9) The toner for the development of an electrostatic image according to any one of Clauses (1) to (8), wherein the absolute value of chargeability of the toner is from 20 to 40 $\mu$C/g and the ratio of chargeability in summer environment (28° C., 85% RH) to chargeability in winter environment (10° C., 30% RH) of the toner is from 0.5 to 1.5.

(10) A process for the preparation of a toner for the development of an electrostatic image according to any one of Clauses (1) to (9) which comprises mixing a particulate resin dispersion having a particulate resin having a particle diameter of 1 $\mu$m or less dispersed therein, a colorant dispersion, a release agent dispersion and an inorganic particulate material dispersion, allowing the mixture to undergo coaggregation to prepare a dispersion of aggregated particles, and then heating the dispersion of aggregated particles to a temperature of not lower than the glass transition point of said particulate resin to cause coalescence of particles.

(11) The process for the preparation of a toner for the development of an electrostatic image according to Clause (10), which comprises adding a particulate resin dispersion to the dispersion of aggregated particles, stirring the mixture so that the particulate resin is attached to the surface of the aggregated particles, and then heating the material to a temperature of not lower than the glass transition point of the particulate resin to cause coalescence of particles.

(12) The process for the preparation of a toner for the development of an electrostatic image according to Clause (10) or (11), wherein the aggregation involves the addition of a salt of inorganic metal having a valence of two or more as a coaggulant.

(13) The process for the preparation of a toner for the development of an electrostatic image according to Clause (12), wherein as the metal salt there is used a tetravalent inorganic salt of aluminum.

(14) An electrostatic image developer comprising a carrier and a toner, characterized in that as the toner there is used a toner for the development of an electrostatic image according to any one of Clauses (1) to (9).

(15) The electrostatic image developer according to Clause (14, wherein the carrier is a resin-coated carrier.

(16) A process for the formation of an image which comprises a step of forming an electrostatic latent image on an electrostatic carrier, a step of developing said electrostatic latent image with a developer layer on a developer carrier to form a toner image, a step of transferring said toner image onto a transferring material, and a step of fixing said toner image, characterized in that a toner according to Clause (14) or (15) is used.

(17) The process for the formation of an image according to Clause (16, wherein the extra toner recovered at the step of forming a toner image is returned to the developer layer.

(18) The process for the formation of an image according to Clause (16) or (17), wherein the fixing step involves oilless fixing.

(19) The process for the formation of an image according to any one of Clauses (16) to (18), wherein the fixing rate at the fixing step is predetermined to a range of from 50 to 200 mm/sec.

DETAILED DESCRIPTION OF THE PREFERRED EMBODIMENTS

The complex viscosity and loss tangent of the invention are dynamic viscoelastic properties determined by temperature dispersion measurement method by sinusoidal oscillation method at an oscillation frequency of 6.28 rad/sec. For the measurement of these properties, ARES measuring instrument produced by Rheometric Scientific Corp. may be used.

In some detail, the toner is pelletized, and then placed between parallel plates having a diameter of 25 mm. The normal force is then adjusted to zero. Thereafter, the sample is given a sinusoidal oscillation at a frequency of 6.28 rad/sec. The measurement begins at 120° C. and then ends at 200° C. From the standpoint of maintenance of desired precision in measurement, it is preferred that the measurement time interval be 30 seconds and the precision in temperature adjustment after the beginning of measurement be within ±1.0° C. During measurement, the strain is properly maintained and adjusted at various measurement temperatures to obtain proper measurements.

In oilless fixing, the peelability of the toner from the fixing roll generally depends on the viscosity and stringiness of the toner thus molten. Stringiness is one of the properties characteristic to high molecular compounds. As stringiness increases, peelability during oilless fixing worsens. Stringiness is affected by the weight-average molecular weight Mw, the presence of crosslinked structure and the crosslinking density of the binder resin for toner but appears when the elasticity and viscosity of the binder resin fall within predetermined ranges. When the binder resin has a high elasticity and a high crosslinking density, stringiness can be easily controlled within a practical fixing temperature range, but the resulting fixed image cannot be provided with a desired surface gloss. This problem becomes remarkable particularly when an amorphous binder resin is used. Further, when the binder resin has a low elasticity, the appearance of stringiness is suppressed, occasionally providing image gloss. However, offset can take place at high temperatures. Thus, such a binder resin can be hardly put in practical use.

In the present invention, in order to satisfy the peelability while providing the fixed image with a sufficient gloss during oilless fixing, the appearance of stringiness at a low elasticity and a low crosslinking density can be suppressed, that is, the ratio of elasticity to viscosity can be adjusted while maintaining a proper elasticity, the ratio of elasticity to viscosity can be adjusted such that complex viscosity determined from the measurements of dynamic viscoelasticity is kept within a predetermined range, and loss tangent tan $\delta$ (=loss elastic modulus/storage elastic modulus) can be kept within a predetermined range. Thus, the foregoing problems can be solved.

In the invention, by controlling the complex viscosity $\eta^*$ of the toner at 160° C. determined by the measurement of temperature dispersion of the toner by sinusoidal oscillation method and the loss tangent tan $\delta$ to a range of from $3.0\times10^2$ to $1.2\times10_3$ Pas and from 0.60 to 1.60, respectively, the temperature dependence of peelability during oilless fixing and the temperature dependence of the amount of toner carried on the image can be suppressed, making it possible to provide a toner excellent in surface gloss of fixed image, OHP transparency and bending resistance of fixed image.

When the foregoing complex viscosity $\eta^*$ falls below $3.0\times10^2$ Pas, the binder resin itself exhibits a lowered cohesive force and thus can easily cause offset at high temperatures. On the contrary, when the complex viscosity $\eta^*$ exceeds $1.2\times10^3$ Pas, the binder resin itself exhibits too great a cohesive force, making it difficult to provide the fixed image with a sufficient surface gloss. Further, when the loss tangent tan δ falls below 0.60, the storage elastic modulus, which is an elasticity term, increases, lowering the surface gloss of fixed image. On the contrary, when the loss tangent tan δ exceeds 1.60, only the viscosity of the binder resin itself increases, worsening stringiness and hence deteriorating peelability during oilless fixing.

In the invention, by adding an inorganic particulate material having a central particle diameter of from 5 nm to 100 nm in an amount of from 2 to 20% by weight based on the weight of the toner, the complex viscosity and loss tangent defined above can be assured, making it possible to obtain the foregoing properties such as temperature dependence of peelability during oilless fixing. When the central particle diameter of the inorganic particulate material falls below 5 nm, only the viscosity of the toner increases during the dispersion of the inorganic particulate material in the toner, raising the term of loss elastic modulus G" in the dynamic viscoelasticity and hence raising the loss tangent tan δ. As a result, stringiness is raised, worsening the peelability during oilless fixing. On the contrary, when the central particle diameter exceeds 100 nm, the storage elastic modulus of toner during fixing increases, raising toughness during the melting of the toner and hence improving peelability. However, aggregated inorganic particles can be formed in the fixed image, impairing OHP transparency. When the added amount of the inorganic particulate material falls below 2% by weight, the inorganic particulate material is thinly dispersed in the toner, making it impossible to exert a desired effect. On the contrary, when the added amount of the inorganic particular material exceeds 20% by weight, the molten toner during fixing exhibits toughness but a deteriorated fluidity, impairing the gloss of fixed image. The deterioration of surface gloss causes deterioration of OHP transparency.

Examples of the inorganic particulate material employable herein include silica, hydrophobicized silica, titanium oxide, aluminum oxide, calcium carbonate, magnesium carbonate, tricalcium phosphate, and colloidal silica. These inorganic particulate materials are preferably subjected to dispersion in the presence of an ionic surfactant, high molecular acid, high molecular base or the like by means of a supersonic dispersing machine or the like before use. Particularly preferred among these inorganic particulate materials is colloidal silica, which doesn't require this dispersion.

The particulate toner having a complex viscosity and a loss tangent according to the invention is preferably prepared by the following coaggregation coalescence method. In some detail, a particulate resin dispersion having a particulate resin with a particle size of at least 1 μm dispersed therein, a colorant dispersion, a release agent dispersion, and an inorganic particulate material dispersion are mixed. If necessary, a coaggulant of an inorganic metal salt having a valence of two or more is added to the mixture to form aggregated particles. Thus, a dispersion of aggregated particles is prepared. The dispersion is heated to a temperature of not lower than the glass transition point of the particulate resin to undergo coalescence, washed, and then dried to obtain the desired particulate toner.

In this method, the step of coalescing the aggregated particles is preferably preceded by a step of adding the particulate resin dispersion or the like to the dispersion of aggregated particles so that the particulate resin or the like is attached to the surface of aggregated particles. The dispersion of coated particles is then heated to undergo coalescence so that resin particles or resin film is attached to the surface of toner particles.

The foregoing inorganic particulate material may be added in the form of dispersion during coaggregation. Alternatively, the inorganic particulate material may be added to a release agent which is then subjected to dispersion.

The foregoing particulate resin dispersion is normally prepared by emulsion polymerization or the like. The particulate resin dispersion having a particulate resin dispersed in an ionic surfactant, a high molecular acid, a high molecular base or the like may be prepared by a process which comprises mixing the particulate resin with a pigment dispersed in an ionic surfactant having a polarity opposite that of the particulate resin to cause coaggregation so that aggregated particles having a diameter corresponding to that of the toner are formed, or mixing a particulate resin dispersion, a colorant dispersion, a release agent dispersion and an inorganic particulate material dispersion, adding a polyvalent metal salt such as tetravalent aluminum salt as a coaggulant to the mixture to cause coaggregation so that aggregated particles are formed, heating the aggregated particles to a temperature of not lower than the glass transition point of the particulate resin to cause coalescence of the agglomerate, washing the material, and then drying the material. The toner may be properly shaped in any form ranging from irregular to sphere depending on the conditions used.

In this process, the various components may be mixed at a time to cause coaggregation. Alternatively, in the aggregation step, the initial amount of various polar ionic dispersants may be slightly ill-balanced. These ionic dispersants may be ionically neutralized with an inorganic metal salt such as calcium nitrate or polymer of inorganic metal salt such as tetravalent polyaluminum chloride. Thus, a first stage aggregated particulate matrix is formed at a temperature of not higher than the glass transition point of the resin. The particulate matrix is then stabilized. At the second stage, to the particulate matrix is added a particle distribution containing a dispersant having such a polarity in such an amount that the ill balance can be compensated for. If necessary, the mixture is then slightly heated to a temperature of not higher than the glass transition point of the resin contained in the aggregated particles or added particles to become stabilized. The mixture is then heated to a temperature of not lower than the glass transition point of the resin so that coalescence occurs with the particles added at the second stage of aggregation attached to the surface of the aggregated particulate matrix. The procedure of attaching added particles to the aggregated particles may be repeated a plurality of times.

In the invention, the toner may comprise a release agent incorporated therein in an amount of from 5 to 25% by weight. In this case, the addition of the release agent is preferably effected before the attachment of added particles to the aggregated particles from the standpoint of chargeability and durability.

The volume-average particle diameter $D_{50}$ of the toner of the invention is preferably from 3 μm to 9 μm, more preferably from 3 μm to 8 μm. When $D_{50}$ falls below 3 μm, the resulting chargeability is insufficient, occasionally deteriorating the developability of the toner. On the contrary, when $D_5$ exceeds 9 μm, the resulting image exhibits a deteriorated definition.

The toner of the invention preferably exhibits a volume-average particle size distribution index GSDv of 1.30 or less and a volume-average particle size distribution index GSDv/n umber-average particle size distribution index GSDp ratio of 0.95 or more. When the volume-average particle size distribution index GSDv exceeds 1.30, the resulting definition is deteriorated. When GSDv/GSDp ratio falls below 0.9, the resulting chargeability is deteriorated, causing image defects such as fog and scattering.

For the definition of volume-average particle diameter $D_{50v}$, volume-average particle size distribution index GSDv and number-average particle size distribution index GSDp of the invention, the particle size distribution is measured by means of a measuring instrument such as Type TAII coal tar counter (produced by Japan Scientific Instrument Co., Ltd.) and Multisizer II (produced by Japan Scientific Instrument Co., Ltd.). The volume and number of particles are accumulated at various particle size ranges (channel) obtained by dividing the particle size distribution by every particle diameter. The volume-average particle diameter and number-average particle diameter at the point where accumulation reaches 16% on the cumulative distribution are defined as $D_{16v}$ and $D_{16p}$, respectively. Similarly, the volume-average particle diameter and number-average particle diameter at the point where accumulation reaches 50% on the cumulative distribution are defined as $D_{50v}$, and $D_{50p}$, respectively, and the volume-average particle diameter and number-average particle diameter at the point where accumulation reaches 84% on the cumulative distribution are defined as $D_{84v}$, and $D_{84p}$, respectively. Using these definitions, the volume-average particle size distribution index GSDv is calculated as the square root of $(D_{84v}/D_{16V})$, and the number-average particle size distribution index GSDp is calculated as the square root of $(D_{84p}/D_{16p})$.

The absolute value of the chargeability of the toner for the development of an electrostatic image of the invention is from 20 to 40 $\mu$C/g, preferably from 15 to 35 $\mu$C/g. When the chargeability of the toner for the development of an electrostatic image falls below 20 $\mu$C/g, background stain (fog) can easily occur. On the contrary, when the chargeability of the toner for the development of an electrostatic image exceeds 40 4$\mu$C/g, the image density can easily drop. The ratio of chargeability in summer environment (28° C., 85% RH) to chargeability in winter environment (10° C., 30% RH) of the toner of the invention is from 0.5 to 1.5, preferably from 0.7 to 1.3. When the chargeability ratio falls outside the above defined range, the chargeability depends more on the environment and thus becomes less stable. This is undesirable from the practical standpoint of view.

The polymer to be used as particulate resin in the toner of the invention is not specifically limited. Examples of the polymer employable herein include styrenes such as styrene, parachlorostyrene and α-methylstyrene, esters having vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate, vinyltolyls such as acrylonitrile and methacrylonitrile, vinylethers such as vinyl methyl ether and vinyl isobutyl ether, vinylketones such as vinyl methyl ketone, vinyl ethyl ketone and vinyl isopropenyl ketone, polymers of monomers such as polyolefin of ethylene, propylene and butadiene, copolymers obtained by combining two or more of these polymers, mixtures thereof, non-vinyl condensed resins such as epoxy resin, polyester resin, polyurethane resin, polyamide resin, cellulose resin and polyether resin, mixtures of these resins with the foregoing vinyl-based resins, and graft polymers obtained by the polymerization of vinyl-based polymers in the presence of these resins.

When the foregoing vinyl-based monomers are used, the particulate resin distribution can be prepared by emulsion polymerization method in the presence of an ionic surfactant or the like. Other resins, if it is oil-based and can be dissolved in a solvent having a relatively low water solubility, may be dispersed in water in the form of solution in the solvent together with an ionic surfactant or high molecular electrolyte by means of a dispersing machine such as homogenizer to prepare a fine aqueous dispersion which is then heated or put under reduced pressure to vaporize the solvent, thereby preparing the desired resin dispersion.

The central particle diameter of the fine particulate resin dispersion thus obtained can be measured by a laser diffraction type particle size distribution measuring apparatus (LA-700, produced by HORIBA, Ltd.).

As the release agent to be used in the invention there is preferably used a material having a main maxima peak at a temperature of 50° C. to 140° C. as measured according to ASTMD3418-8. The release agent having such a main maxima peak at a temperature of lower than 50° C. can easily cause offset. On the contrary, the release agent having such a main maxima peak at a temperature of higher than 140° C. exhibits a raised fixability temperature, making it impossible to provide the fixed image with a sufficient surface smoothness and hence impairing the gloss of the fixed image.

For the measurement of the main maxima peak of the release agent, DSC-7 produced by Perkinelmer Corp. may be used. For the temperature correction of the detecting portion of the apparatus, the melting point of indium and zinc are used. For the correction of amount of heat, the heat of fusion of indium is used. As a sample there is used an aluminum pan. As a control there is used an empty pan. The measurement is effected at a heat rise rate of 10° C./min.

Specific examples of the release agent employable herein include low molecular polyolefins such as polyethylene, polypropylene and polybutene, silicones having a point of softening by heating, aliphatic acid amides such as oleic acid amide, erucic acid amide, ricinoleic acid amide and stearic acid amide, vegetable-based waxes such as carnauba wax, rice wax, candelilla wax, Japan wax and jojoba oil, animal-based waxes such as beeswax, mineral and petroleum-based waxes such as montan wax, ozokerite, ceresin wax, paraffin wax, microcrystalline wax and Fischer-Tropsch wax, and modification products thereof.

These waxes may be each dispersed in water with an ionic surfactant or a high molecular electrolyte such as high molecular acid and high molecular base, heated to a temperature of not lower than the melting point thereof, and then atomized by a strong shearing action developed by a homogenizer or pressure-discharging dispersing machine to prepare a dispersion having particles with a central particle diameter of 1 $\mu$m or less dispersed therein.

For the measurement of the central particle diameter of the particulate resin dispersion thus obtained, a laser diffraction type particle size distribution measuring apparatus (LA-700, produced by HORIBA, Ltd.) may be used.

As the colorant to be used in the invention there may be used any known colorant.

Examples of black pigment include carbon black, copper oxide, manganese dioxide, aniline black, activated carbon, non-magnetic ferrite, and magnetite.

Examples of yellow pigment include chrome yellow, zinc yellow, yellow oxide, cadmium yellow, Hansa yellow, Hansa yellow 10G, benzidine yellow G, benzidine yellow GR, threne yellow, and permanent yellow NCG.

Examples of orange pigment include red chrome yellow, molybdenum orange, permanent orange GTR, pyrazolone orange, vulcan orange, benzidine orange G, indathrene brilliant orange RK, and indathrene brilliant orange GK.

Examples of red pigment include red oxide, cadmium red, red lead oxide, mercury sulfate, Watchung red, permanent red 4R, lithol red, brilliant carmine 3B, brilliant carmine 6B, Du pont oil red, pyrazolone red, rhodamine B lake, lake red C, rose bengale, eoxine red, and alizarine lake.

Examples of blue pigment include Prussian blue, cobalt blue, alkali blue lake, victoria blue lake, fast sky blue, indathrene blue BC, aniline blue, ultramarine blue, chalcoil blue, methylene blue chloride, phthalocyanine blue, phthalocyanine green, and malachite green oxalate.

Examples of purple pigment include manganese violet, fast violet B, and methyl violet lake.

Examples of green pigment include chromium oxide, chromium green, pigment green, malachite green lake, and final yellow green G.

Examples of white pigment include zinc oxide, titanium oxide, antimony white, and zinc sulfate.

Examples of extender pigment include barytes powder, barium carbonate, clay, silica, white carbon, talc, and alumina white.

Examples of dye include various dyes such as basic dye, acidic dye, disperse dye and direct dye. Specific examples of these dyes include nigrosine, methylene blue, rose bengale, quinoline yellow, and ultramarine blue.

These colorants may be used singly or in admixture or in the form of solid solution.

These colorants may be dispersed by any known method. For example, a media type dispersing machine such as rotary shearing type homogenizer, ball mill, sand mill and attritor, high pressure collision type dispersing machine, etc. may be preferably used.

These colorants may be dispersed in an aqueous system in the presence of a polar surfactant by means of the foregoing homogenizer.

The colorant of the invention may be selected from the standpoint of hue angle, chroma, lightness, weathering resistance, OHP transparency, and dispersibility in toner. The amount of these colorants to be added is from 1 to 20 parts by weight based on 100 parts by weight of the resin.

When a magnetic material is used as a black colorant, it is added in an amount of from 30 to 100 parts by weight unlike other colorants.

In the case where the toner of the invention is used as a magnetic toner, it may comprise a magnetic powder incorporated therein. As such a magnetic powder there may be used a material which can be magnetized in a magnetic field. A ferromagnetic powder such as iron, cobalt and nickel powder or a compound such as ferrite and magnetite may be used.

In the present invention, since the toner is prepared in an aqueous phase, it is necessary that particular attention be given to the aqueous phase migration of the magnetic material. Therefore, it is preferred that the magnetic material be subjected to surface modification such as hydrophocization before use.

The shape factor SF1 of the invention is preferably adjusted to a range of from 110 to 120 from the standpoint of image forming properties. The average of shape factor SF1 of the invention (square of perimeter/projected area) can be determined, e.g., in the following manner. In some detail, an optical microscope image of toner particles scattered on a slide glass is taken into a Luzex image analyzer through a vide camera. On 50 or more toner particles, the value of ($ML^2/A$) obtained by dividing the square of perimeter (ML) of particle is calculated. These values are then averaged.

The toner of the invention may comprise a static controller incorporated therein to further enhance and stabilizer the chargeability thereof. As such a static controller there may be used any of commonly used static controllers such as quaternary ammonium salt compound, nigrosine compound, dye made of complex of aluminum, iron and chromium and triphenylmethane-based pigment. In practice, however, a static controller which can be difficultly dissolved in water is preferably used from the standpoint of controllability of ion intensity, which has an effect on the stability at the aggregation step or coalescence step, and the inhibition of pollution by waste water.

The toner of the invention may comprise an inorganic particulate material incorporated therein in wet process to stabilize the chargeability thereof. As the inorganic particulate material to be added there may be used a dispersion of any of materials which can be commonly used as external additives for toner surface such as silica, alumina, titania, calcium carbonate, magnesium carbonate and tricalcium phosphate with an ionic surfactant, high molecular acid or high molecular base.

For the purpose of providing the toner with fluidity or enhancing the cleaning properties of the toner, the toner of the invention may be dried similarly to ordinary toner, and then mixed with an inorganic particulate material such as silica, alumina, titania and calcium carbonate powder or particulate resin such as vinyl-based resin, polyester and silicone powder in dried state while being subject to shearing so that the particulate material can be attached to the surface of the toner particles.

In the preparation of the toner of the invention, a surfactant may be used for emulsion polymerization, dispersion of pigment, dispersion of particulate resin, dispersion of release agent, aggregation, or stabilization thereof.

Specific examples of the surfactant employable herein include anionic surfactants such as sulfuric acid-based surfactant, sulfonic acid-based surfactant, phosphoric acid-based surfactant and soap-based surfactant, and cationic surfactants such as amine salt type surfactant and quaternary ammonium salt type surfactant. It is also effective to use a nonionic surfactant such as polyethyleneglycol-based surfactant, alkylphenolethylene oxide adduct-based surfactant and polyvalent alcohol-based surfactant in addition to these surfactants. As a dispersing means there may be used a rotary shearing type homogenizer or an ordinary dispersing machine having media such as ball mill, sand mill and dynomill.

In the invention, the coaggregation step and coalescence step are followed by a cleaning step, a solid-liquid separation step and a drying step to obtain the desired toner. In the cleaning step, the material is preferably subjected thoroughly to displacement cleaning with ion-exchanged water to secure chargeability. The solid-liquid separation step is not specifically limited. From the standpoint of productivity, filtration with suction, filtration under pressure or the like is preferably effected. The drying step is not specifically limited. From the standpoint of productivity, freeze drying, flash jet drying, fluidized drying, oscillation type fluidized drying or the like is preferably effected.

EXAMPLE

The present invention will be further described in the following examples, but the present invention should not be construed as being limited thereto.

Preparation of Particulate Resin Dispersion (1)

| | |
|---|---|
| Styrene | 308 parts by weight |
| n-Butyl acrylate | 92 parts by weight |
| Acrylic acid | 6 parts by weight |
| Propanediol diacrylate | 1.0 part by weight |
| Dodecanethiol | 2.7 parts by weight |

To a solution obtained by mixing the foregoing components is added a solution of 4 g of an anionic surfactant Dowfax (produced by Rhodia Corp.) in 550 g of ion-exchanged water. The mixture is then slowing stirred while being subjected to dispersion and emulsification in a flask for 10 minutes. Subsequently, to the mixture is added 50 g of ion-exchanged water having 6 g of ammonium persulfate. Thereafter, the air in the system is replaced by nitrogen. The flask is then heated over an oil bath with stirring until the temperature of the interior of the system reached 70° C. where emulsion polymerization continued for 5 hours.

As a result, a particulate resin dispersion (1) comprising a particulate resin having a central particle diameter of 178 nm, a solid content of 42%, a glass transition point of 49.7° C. and a weight-average molecular weight of 38,000 is obtained.

Preparation of Colorant Dispersion (1)

| | |
|---|---|
| Yellow pigment (PY180, produced by Clariant Japan Corp.) | 45 parts by weight |
| Nonionic surfactant (Nonipole 400, produced by Kao Corp.) | 5 parts by weight |
| Ion-exchanged water | 200 parts by weight |

The foregoing components are mixed to make a solution which is then subjected to dispersion by a homogenizer (Ultratalax, produced by IKA Corp.) for 10 minutes to obtain a colorant dispersion (1) comprising a particulate colorant having a central particle diameter of 168 nm.

Preparation of Colorant Dispersion (2)

A colorant dispersion (2) comprising a particulate colorant having a central particle diameter of 177 nm is obtained in the same manner as the colorant dispersion (1) except that as the colorant there is used a cyan pigment (copper phthalocyanine B 15: 3, produced by DAINICHISEIKA COLOUR & CHEMICALS MFG. CO., LTD.).

Preparation of Colorant Dispersion (3)

A colorant dispersion (3) comprising a particulate colorant having a central particle diameter of 186 nm is obtained in the same manner as the colorant dispersion (1) except that as the colorant there is used a magenta pigment (PR122, produced by DAINIPPON INK & CHEMICALS, INC.).

A colorant dispersion (4) comprising a particulate colorant having a central particle diameter of 159 nm is obtained in the same manner as the colorant dispersion (1) except that as the colorant there is used a black pigment (carbon black, produced by Cabot Specialty Chemicals Inc.).

Preparation of Inorganic Particulate Material Dispersion (1)

| | |
|---|---|
| Hydrophobicized silica (R972, produced by Nippon Aerosil Co., Ltd.) | 25 parts by weight |
| Nonionic surfactant (Nonipole 400, produced by Kao Corp.) | 5 parts by weight |
| Ion-exchanged water | 170 parts by weight |

The foregoing components are mixed to make a solution which is then subjected to dispersion by a homogenizer (Ultratalax, produced by IKA Corp.) for 10 minutes to obtain a colorant dispersion (1) comprising an inorganic particulate material having a central particle diameter of 17 nm.

Preparation of Inorganic Particulate Material Dispersion (2)

An inorganic particulate material dispersion (2) comprising an inorganic particulate material having a central particle diameter of 16 nm is obtained in the same manner as the inorganic particulate material dispersion (1) except that the hydrophobicized silica is replaced by an untreated silica (QS10, produced by Tokuyama Co., Ltd.).

Preparation of inorganic particulate material dispersion (3)

An inorganic particulate material dispersion (3) comprising an inorganic particulate material having a central particle diameter of 40 nm is obtained in the same manner as the inorganic particulate material dispersion (1) except that the hydrophobicized silica is replaced by microtitanium oxide (STT100H, produced by Titan Kogyo K.K.).

Preparation of Release Agent Dispersion (1)

| | |
|---|---|
| Paraffin wax (HNPO190; m.p.: 85C, produced by Nippon Seiro Co., Ltd.) | 45 parts by weight |
| Cationic surfactant (Sanisol B50, produced Kao Corp.) | 5 parts by weight |
| Ion-exchanged water | 200 parts by weight |

The foregoing components are thoroughly subjected to dispersion by Ultratalax T50 (produced by IKA Corp.) while being heated to a temperature of 95° C., and then further subjected to dispersion by a pressure-discharging dispersing machine to obtain a release agent dispersion (1) comprising a particulate release agent having a central particle diameter of 180 nm and a solid content of 21.5%.

Example 1

| | |
|---|---|
| Particulate resin dispersion (1) | 200 parts by weight |
| Colorant dispersion (1) | 40 parts by weight |
| Inorganic particulate material | 160 parts by weight |

-continued

| | |
|---|---|
| dispersion (1) (content of inorganic particulate material based on the weight of toner: 20% by weight) | |
| Release agent dispersion (1) (content of release agent based on the weight of toner: 8% by weight) | 40 parts by weight |
| polyaluminum chloride | 1.23 parts by weight |

The foregoing components are thoroughly subjected to mixing and dispersion by Ultratalax T50 (produced by IKA Corp.) in a stainless steel round flask, and then heated to a temperature of 48° C. over a heating oil bath with stirring. This state is then kept for 60 minutes to prepare a dispersion of aggregated particles. To the dispersion are then added 68parts by weight of the particulate resin dispersion (1).

Thereafter, to the dispersion of aggregated particles is added a 0.5 mol/l aqueous solution of sodium hydroxide to adjust the pH value thereof to 5.6. The stainless steel flask is then sealed. Using a magnetic seal, the dispersion is heated to a temperature of 95° C. with continued stirring. This state is then kept for 5 hours so that resin particles are attached to the surface of the aggregated particles to prepare a dispersion of coated particles.

After the termination of reaction, the dispersion is cooled, filtered, thoroughly washed with ion-exchanged water, subjected to nutsche suction filtration to undergo solid-liquid separation, redispersed in 3 l of 40° C. ion-exchanged water, and then stirred at a rotary speed of 300 rpm so that it is washed.

This washing step is repeated five times. When the filtrate exhibited a pH value of 6.56, an electrical conductivity of 7.1 μS/cm and a surface tension of 71.0 N.m, the material is then subjected to nutsche suction filtration through No. 5A filter paper to undergo solid-liquid separation. Subsequently, the material is vacuum-dried for 12 hours to obtain a particulate toner of Example 1.

The particle diameter of the toner particles is then measured by means of a coal tar counter. As a result, the volume-average particle diameter $D_{50}$ is 5.4 μm, the volume-average particle size distribution index GSDv is 1.19, and the ratio of volume-average particle size distribution index GSDv to number-average particle size distribution index GSDp (GSDv/GSDp) is 1.11. The particulate toner is also observed to have a shape factor SF1 of 115.8 as determined by a Roozex image analyzer, demonstrating that the particle is spherical. The 160° C. complex viscosity and tan δ determined from the measurements of dynamic viscoelasticity of the toner particles are $1.10\times10^3$ Pas and 0.63, respectively.

Preparation of Developer

To 50 g of the foregoing particulate toner is added 2 g of a hydrophobicized silica (TS720, produced by Cabot Specialty Chemicals Inc.). The mixture is then subjected to blending by a sample mill to obtain an external additive toner of Example 1.

The external additive toner of Example 1 is then measured out in an amount of 1% by weight in such an amount that the toner concentration is 5% by weight based on the weight of a ferrite carrier having an average particle diameter of 50 μm coated with a polymethyl methacrylate (produced by Soken chemical & Engineering Co., Ltd.). The two components are then blended with stirring by a ball mill for 5minutes to prepare a developer of Example 1.

Evaluation

Using a remodelled version of A Color 645 produced by Fuji Xerox Co., Ltd. with the developer of Example 1, the particulate toner of Example 1 is examined for fixability during oilless fixing, peelability, surface gloss of fixed image and OHP sheet transparency with the fixing rate being predetermined to 200 mm/sec, the carried amount of toner being predetermined to 4.5 g/m$^2$, 9.0 g/m$^2$ and 13.5 g/m$^2$ and the fixing temperature being predetermined to 160° C., 180° C. and 200° C. As a result, oilless fixing properties are good under any conditions. The toner is peeled without any resistance regardless of the carried amount of the toner. Under any conditions, the fixed image had a surface gloss, and no high temperature offset occurred. Further, OHP sheet transparency is good, and there is observed no turbidity in transparency.

Example 2

A particulate toner of Example 2 is prepared in the same manner as in Example 1 except that the inorganic particulate material dispersion (2) is added instead of the inorganic particulate material dispersion (1) in an amount of 80 parts by weight (content of inorganic particulate material based on the weight of the toner: 9.5% by weight) and the colorant dispersion (2) is added instead of the colorant dispersion (1) in the same manner as in Example 1. The content of the release agent based on the weight of the toner is 8% by weight.

The particulate toner thus obtained is then observed to have a volume-average particle diameter $D_{50}$ of 5.1 μm, a volume-average particle size distribution index GSDv of 1.21, a volume-average particle size distribution index (GSDv)/number-average particle size distribution index (GSDp) ratio of 0.97 and a shape factor SF1 of 117.2 demonstrating that the particle is spherical. The 160° C. complex viscosity and tan δ determined from the measurements of dynamic viscoelasticity of the toner particles are $9.7\times10^2$ Pas and 0.87, respectively. The particulate toner is then processed in the same manner as in Example 1 to prepare a developer of Example 2.

Evaluation

Under the same conditions as in Example 1, the developer of Example 2 is then examined for fixability during oilless fixing, peelability, surface gloss of fixed image and OHP sheet transparency. As a result, oilless fixing properties are good under any conditions. The toner is peeled without any resistance regardless of the carried amount of the toner. Under any conditions, the fixed image had a surface gloss, and no high temperature offset occurred. Further, OHP sheet transparency is good, and there is observed no turbidity in transparency.

Example 3

A particulate toner of Example 3 is prepared in the same manner as in Example 1 except that a colloidal silica (ST-100; central particle diameter: 100 nm, produced by Nissan Chemical Industries, Ltd.) is added instead of the inorganic particulate material dispersion (1) in an amount of 60 parts by weight (content of silica based on the weight of the toner: 10% by weight) and the colorant dispersion (3) is added instead of the colorant dispersion (1) in the same manner as in Example 1. The content of the release agent based on the weight of the toner is 8.5% by weight.

The particulate toner thus obtained is then observed to have a volume-average particle diameter $D_{50}$ of 5.3 μm, a volume-average particle size distribution index GSDv of 1.20, a volume-average particle size distribution index (GSDv)/number-average particle size distribution index (GSDp) ratio of 0.99 and a shape factor SF1 of 111.2 demonstrating that the particle is spherical. The 160° C. complex viscosity and tan δ determined from the measurements of dynamic viscoelasticity of the toner particles are $7.2\times10^2$ Pas and 1.20, respectively. The particulate toner is then processed in the same manner as in Example 1 to prepare a developer of Example 3.

Evaluation

Under the same conditions as in Example 1, the developer of Example 3 is then examined for fixability during oilless fixing, peelability, surface gloss of fixed image and OHP sheet transparency. As a result, oilless fixing properties are good under any conditions. The toner is peeled without any resistance regardless of the carried amount of the toner. Under any conditions, the fixed image had a surface gloss, and no high temperature offset occurred. Further, OHP sheet transparency is good, and there is observed no turbidity in transparency.

Example 4

A particulate toner of Example 4 is prepared in the same manner as in Example 1 except that a colloidal silica (ST-OL; central particle diameter: 40 nm, produced by Nissan Chemical Industries, Ltd.) is added instead of the inorganic particulate material dispersion (1) in an amount of 30 parts by weight (content of silica based on the weight of the toner: 5% by weight) and the colorant dispersion (4) is added instead of the colorant dispersion (1) in the same manner as in Example 1. The content of the release agent based on the weight of the toner is 8.5% by weight.

The particulate toner thus obtained is then observed to have a volume-average particle diameter $D_{50}$ of 5.4 μm, a volume-average particle size distribution index GSDv of 1.24, a volume-average particle size distribution index (GSDv)/number-average particle size distribution index (GSDp) ratio of 1.15 and a shape factor SF1 of 117.2 demonstrating that the particle is spherical. The 160° C. complex viscosity and tan δ determined from the measurements of dynamic viscoelasticity of the toner particles are $1.17\times10^3$ Pas and 0.64, respectively. The particulate toner is then processed in the same manner as in Example 1 to prepare a developer of Example 4.

Evaluation

Under the same conditions as in Example 1, the developer of Example 4 is then examined for fixability during oilless fixing, peelability, surface gloss of fixed image and OHP sheet transparency. As a result, oilless fixing properties are good under any conditions. The toner is peeled without any resistance regardless of the carried amount of the toner. Under any conditions, the fixed image had a surface gloss, and no high temperature offset occurred. Further, OHP sheet transparency is good, and there is observed no turbidity in transparency.

Example 5

A particulate toner of Example 5 is prepared in the same manner as in Example 1 except that a colloidal silica (ST-O; central particle diameter: 8 nm, produced by Nissan Chemical Industries, Ltd.) is added instead of the inorganic particulate material dispersion (1) in an amount of 60 parts by weight (content of silica based on the weight of the toner: 5% by weight) and the colorant dispersion (4) is added instead of the colorant dispersion (1) in the same manner as in Example 1. The content of the release agent based on the weight of the toner is 8% by weight.

The particulate toner thus obtained is then observed to have a volume-average particle diameter $D_{50}$ of 5.2 μm, a volume-average particle size distribution index GSDv of 1.22, a volume-average particle size distribution index (GSDv)/number-average particle size distribution index (GSDp) ratio of 1.16 and a shape factor SF1 of 116.4 demonstrating that the particle is spherical. The 160° C. complex viscosity and tan δ determined from the measurements of dynamic viscoelasticity of the toner particles are $3.30\times10^2$ Pas and 1.56, respectively. The particulate toner is then processed in the same manner as in Example 1 to prepare a developer of Example 5.

Evaluation

Under the same conditions as in Example 1, the developer of Example 5 is then examined for fixability during oilless fixing, peelability, surface gloss of fixed image and OHP sheet transparency. As a result, oilless fixing properties are good under any conditions. The toner is peeled without any resistance regardless of the carried amount of the toner. Under any conditions, the fixed image had a surface gloss, and no high temperature offset occurred. Further, OHP sheet transparency is good, and there is observed no turbidity in transparency.

Example 6

A particulate toner of Example 6 is prepared in the same manner as in Example 1 except that a colloidal silica (ST-O; central particle diameter: 8 nm, produced by Nissan Chemical Industries, Ltd.) is added instead of the inorganic particulate material dispersion (1) in an amount of 120 parts by weight (content of silica based on the weight of the toner: 20% by weight) and the colorant dispersion (4) is added instead of the colorant dispersion (1) in the same manner as in Example 1. The content of the release agent based on the weight of the toner is 7% by weight.

The particulate toner thus obtained is then observed to have a volume-average particle diameter $D_{50}$ of 5.6 μm, a volume-average particle size distribution index GSDv of 1.25, a volume-average particle size distribution index (GSDv)/number-average particle size distribution index (GSDp) ratio of 1.19 and a shape factor SF1 of 118.1 demonstrating that the particle is spherical. The 160° C. complex viscosity and tan δ determined from the measurements of dynamic viscoelasticity of the toner particles are $6.60\times10^2$ Pas and 1.09, respectively. The particulate toner is then processed in the same manner as in Example 1 to prepare a developer of Example 6.

Evaluation

Under the same conditions as in Example 1, the developer of Example 5 is then examined for fixability during oilless fixing, peelability, surface gloss of fixed image and OHP sheet transparency. As a result, oilless fixing properties are good under any conditions. The toner is peeled without any resistance regardless of the carried amount of the toner. Under any conditions, the fixed image had a surface gloss, and no high temperature offset occurred. Further, OHP sheet transparency is good, and there is observed no turbidity in transparency.

Example 7

A particulate toner of Example 7 is prepared in the same manner as in Example 1 except that microtitanium oxide is added instead of the inorganic particulate material dispersion (1) in an amount of 80 parts by weight (content of silica based on the weight of the toner: 10% by weight) and the colorant dispersion (2) is added instead of the colorant dispersion (1) in the same manner as in Example 1. The content of the release agent based on the weight of the toner is 8% by weight.

The particulate toner thus obtained is then observed to have a volume-average particle diameter $D_{50}$ of 5.4 μm, a volume-average particle size distribution index GSDv of 1.24, a volume-average particle size distribution index (GSDv)/number-average particle size distribution index (GSDp) ratio of 1.15 and a shape factor SF1 of 117.2 demonstrating that the particle is spherical. The 160° C. complex viscosity and tan δ determined from the measurements of dynamic viscoelasticity of the toner particles are $8.15\times10^2$ Pas and 1.07, respectively. The particulate toner is then processed in the same manner as in Example 1 to prepare a developer of Example 7.

Evaluation

Under the same conditions as in Example 1, the developer of Example 7 is then examined for fixability during oilless fixing, peelability, surface gloss of fixed image and OHP sheet transparency. As a result, oilless fixing properties are good under any conditions. The toner is peeled without any resistance regardless of the carried amount of the toner. Under any conditions, the fixed image had a surface gloss, and no high temperature offset occurred. Further, OHP sheet transparency is good, and there is observed no turbidity in transparency.

Comparative Example 1

A particulate toner of Comparative Example 1 is prepared in the same manner as in Example 1 except that a colloidal silica (ST-OL; central particle diameter: 40 nm, produced by Nissan Chemical Industries, Ltd.) is added instead of the inorganic particulate material dispersion (1) in an amount of 180 parts by weight (content of silica based on the weight of the toner: 22.5% by weight) and the colorant dispersion (2) is added instead of the colorant dispersion (1) in the same manner as in Example 1. The content of the release agent based on the weight of the toner is 7.5% by weight.

The particulate toner thus obtained is then observed to have a volume-average particle diameter $D_{50}$ of 5.6 μm, a volume-average particle size distribution index GSDv of 1.25, a volume-average particle size distribution index (GSDv)/number-average particle size distribution index (GSDp) ratio of 1.21 and a shape factor SF1 of 119.7 demonstrating that the particle is spherical. The 160° C. complex viscosity and tan δ determined from the measurements of dynamic viscoelasticity of the toner particles are $2.40\times10^3$ Pas and 0.52, respectively. The particulate toner is then processed in the same manner as in Example 1 to prepare a developer of Comparative Example 1.

Evaluation

Under the same conditions as in Example 1, the developer of Comparative Example 1 is then examined for fixability during oilless fixing, peelability, surface gloss of fixed image and OHP sheet transparency. As a result, there is shown a slight deterioration of oilless fixing properties under any conditions. The toner is peeled without any resistance regardless of the carried amount of the toner. However, the resulting fixed image had an insufficient surface gloss. The resulting OHP sheet had a low transparency, and there is observed some turbidity in transparency.

Comparative Example 2

A particulate toner of Comparative Example 2 is prepared in the same manner as in Example 1 except that a colloidal silica (ST-OL; central particle diameter: 40 nm, produced by Nissan Chemical Industries, Ltd.) is added instead of the inorganic particulate material dispersion (1) in an amount of 9 parts by weight (content of silica based on the weight of the toner: 1.5% by weight) and the colorant dispersion (2) is added instead of the colorant dispersion (1) in the same manner as in Example 1. The content of the release agent based on the weight of the toner is 9% by weight.

The particulate toner thus obtained is then observed to have a volume-average particle diameter $D_{50}$ of 5.2 μm, a volume-average particle size distribution index GSDv of 1.21, a volume-average particle size distribution index (GSDv)/number-average particle size distribution index (GSDp) ratio of 1.20 and a shape factor SF1 of 117.7 demonstrating that the particle is spherical. The 160° C. complex viscosity and tan δ determined from the measurements of dynamic viscoelasticity of the toner particles are $2.70\times10^2$ Pas and 1.68, respectively. The particulate toner is then processed in the same manner as in Example 1 to prepare a developer of Comparative Example 2.

Evaluation

Under the same conditions as in Example 1, the developer of Comparative Example 1 is then examined for fixability during oilless fixing, peelability, surface gloss of fixed image and OHP sheet transparency. As a result, oilless fixing properties are good under any conditions. However, when the fixing temperature is 160° C. or 180° C. and the carried amount of toner is 4.5 g/m$^2$ or 9.0 g/m$^2$, there occurred sticking, making it impossible to obtain an image. No high temperature offset occurred up to 180° C. When the fixing temperature is 200° C. and the carried amount of toner is 4.5 g/m$^2$, there occurred high temperature offset. The resulting OHP sheet showed a surface roughness due to high temperature offset, and there is observed some turbidity in transparency.

Comparative Example 3

A particulate toner of Comparative Example 3 is prepared in the same manner as in Example 1 except that the inorganic particulate material dispersion (2) is added instead of the inorganic particulate material dispersion (1) in an amount of 26 parts by weight (content of silica based on the weight of the toner: 2.0% by weight) and the colorant dispersion (2) is added instead of the colorant dispersion (1) in the same manner as in Example 1. The content of the release agent based on the weight of the toner is 9% by weight.

The particulate toner thus obtained is then observed to have a volume-average particle diameter $D_{50}$ of 5.3 μm, a volume-average particle size distribution index GSDv of 1.20, a volume-average particle size distribution index (GSDv)/number-average particle size distribution index (GSDp) ratio of 1.18 and a shape factor SF1 of 115.2 demonstrating that the particle is spherical. The 160° C. complex viscosity and tan δ determined from the measurements of dynamic viscoelasticity of the toner particles are $1.70\times10^2$ Pas and 2.03, respectively. The particulate toner is then processed in the same manner as in Example 1 to prepare a developer of Comparative Example 3.

Evaluation

Under the same conditions as in Example 1, the developer of Comparative Example 1 is then examined for fixability during oilless fixing, peelability, surface gloss of fixed image and OHP sheet transparency. As a result, oilless fixing properties are good under any conditions. However, when the fixing temperature is 180° C. and the carried amount of toner is 4.5 g/m$^2$, there occurred high temperature offset. Further, the resulting gloss dropped because the developer permeated the paper. When the fixing temperature is 200°

C., there occurred sticking to the fixing roll. The resulting OHP sheet showed a surface roughness due to high temperature offset, and there is observed some turbidity in transparency.

Comparative Example 4

A particulate toner of Comparative Example 4 is prepared in the same manner as in Example 1 except that the inorganic particulate material dispersion (2) is added instead of the inorganic particulate material dispersion (1) in an amount of 240 parts by weight (content of silica based on the weight of the toner: 25.0% by weight) and the colorant dispersion (2) is added instead of the colorant dispersion (1) in the same manner as in Example 1. The content of the release agent based on the weight of the toner is 5% by weight.

The particulate toner thus obtained is then observed to have a volume-average particle diameter $D_{50}$ of 5.8 $\mu$m, a volume-average particle size distribution index GSDv of 1.26, a volume-average particle size distribution index (GSDv)/number-average particle size distribution index (GSDp) ratio of 1.27 and a shape factor SF1 of 120.4 demonstrating that the particle is spherical. The 160° C. complex viscosity and tan δ determined from the measurements of dynamic viscoelasticity of the toner particles are $2.97\times10^3$ Pas and 0.51, respectively. The particulate toner is then processed in the same manner as in Example 1 to prepare a developer of Comparative Example 4.

Evaluation

Under the same conditions as in Example 1, the developer of Comparative Example 4 is then examined for fixability during oilless fixing, peelability, surface gloss of fixed image and OHP sheet transparency. As a result, there is shown some drop of oilless fixing properties. However, the toner could be peeled without any resistance regardless of the change of the carried amount of toner. When the fixing temperature is from 160° C. to 200° C., no high temperature offset occurred. The resulting fixed image had an insufficient surface gloss under any conditions. The resulting OHP sheet had a low transparency, and there is observed some turbidity in transparency.

TABLE 1

| | Example 1 | | | | Example 2 | | | | Example 3 | | | | Example 4 | | | |
|---|---|---|---|---|---|---|---|---|---|---|---|---|---|---|---|---|
| Inorganic particulate material/central particle diameter/added amount | Hydrophobicized silica/14 nm/9.5 wt-% | | | | Untreated silica/16 nm/9.5 wt-% | | | | Colloidal silica/100 nm/10 wt-% | | | | Colloidal silica/180 nm/5 wt-% | | | |
| Release agent (wt-%) | 8.0 | | | | 8.0 | | | | 8.8 | | | | 8.5 | | | |
| Complex viscosity η*(×10² Pas) | 11.0 | | | | 9.7 | | | | 7.2 | | | | 11.7 | | | |
| Loss tangent tan δ | 0.53 | | | | 0.87 | | | | 1.20 | | | | 0.64 | | | |
| Volume-average particle diameter $D_{50}$ (pm) | 5.4 | | | | 5.1 | | | | 5.3 | | | | 5.4 | | | |
| GSDv | 1.19 | | | | 1.21 | | | | 1.20 | | | | 1.24 | | | |
| GSDv/GSDp | 1.11 | | | | 0.97 | | | | 0.99 | | | | 1.15 | | | |
| Shape factor SF1 | 115.8 | | | | 117.2 | | | | 111.2 | | | | 117.2 | | | |
| Fixability(1)/peelability (2)/gloss(3)/offset resistance(4) | (1) | (2) | (3) | (4) | (1) | (2) | (3) | (4) | (1) | (2) | (3) | (4) | (1) | (2) | (3) | (4) |
| (a) Carried amount of toner 4.5 g/m² fixing temperature: | | | | | | | | | | | | | | | | |
| 1.160° C. | | | | | | | | | | | | | | | | |
| 2.180° C. | good | good | good | good | good | good | good | good | good | good | good | good | good | good | good | good |
| 3.200° C. | good | good | good | good | good | good | good | good | good | good | good | good | good | good | good | good |
| (b) Carried amount of toner 9.0 g/m² fixing temperature: | good | good | good | good | good | good | good | good | good | good | good | good | good | good | good | good |
| 1.160° C. | good | good | good | good | good | good | good | good | good | good | good | good | good | good | good | good |
| 2.180° C. | good | good | good | good | good | good | good | good | good | good | good | good | good | good | good | good |
| 3.200° C. | good | good | good | good | good | good | good | good | good | good | good | good | good | good | good | good |
| (c) Carried amount of toner 13.5 g/m² fixing temperature: | | | | | | | | | | | | | | | | |
| 1.160° C. | good | good | good | good | good | good | good | good | good | good | good | good | good | good | good | good |
| 2.188° C. | good | good | good | good | good | good | good | good | good | good | good | good | good | good | good | good |
| 3.200° C. | good | good | good | good | good | good | good | good | good | good | good | good | good | good | good | good |
| OHP sheet transparency | Good | | | | Good | | | | Good | | | | Good | | | |

TABLE 2

| | Example 5 | | | | Example 6 | | | | Example 7 | | | |
|---|---|---|---|---|---|---|---|---|---|---|---|---|
| Inorganic particulate material/central particle diameter/added amount | Colloidal silica /8 nm/5 wt-% | | | | Colloidal silica/8 nm/ 20 wt-% | | | | Titanium oxide/40 nm/10 wt-% | | | |
| Release agent (wt-%) | 8.5 | | | | 7.0 | | | | 8.0 | | | |
| Complex viscosity η* ($\times 10^2$ Pas) | 8.3 | | | | 6.6 | | | | 8.15 | | | |
| Loss tangent tan δ | 1.56 | | | | 1.09 | | | | 1.07 | | | |
| Volume-average particle diameter $D_{50}$ (μm) | 5.2 | | | | 5.6 | | | | 5.4 | | | |
| GSDv | 1.22 | | | | 1.25 | | | | 1.24 | | | |
| GSDv/GSDp | 1.16 | | | | 1.19 | | | | 1.15 | | | |
| Shape factor SF1 | 116.4 | | | | 118.1 | | | | 117.2 | | | |
| Fixability(1)/peelability (2)/gloss (3)/offset resistance(4) | (1) | (2) | (3) | (4) | (1) | (2) | (3) | (4) | (1) | (2) | (3) | (4) |
| (a) Carried amount of toner 4.5 g/m$^2$ | | | | | | | | | | | | |
| Fixing temperature: | | | | | | | | | | | | |
| 1.160° C. | good | good | good | good | good | good | good | good | good | good | good | good |
| 2.180° C. | good | good | good | good | good | good | good | good | good | good | good | good |
| 3.200° C. | good | good | good | good | good | good | good | good | good | good | good | good |
| (b) Carried amount of toner 9.0 g/m$^2$ | | | | | | | | | | | | |
| Fixing temperature: | | | | | | | | | | | | |
| 1.160° C. | good | good | good | good | good | good | good | good | good | good | good | good |
| 2.180° C. | good | good | good | good | good | good | good | good | good | good | good | good |
| 3.200° C. | good | good | good | good | good | good | good | good | good | good | good | good |
| (c) Carried amount of toner 13.5 g/m$^2$ | | | | | | | | | | | | |
| Fixing temperature: | | | | | | | | | | | | |
| 1.160° C. | good | good | good | good | good | good | good | good | good | good | good | good |
| 2.180° C. | good | good | good | good | good | good | good | good | good | good | good | good |
| 3.200° C. | good | good | good | good | good | good | good | good | good | good | good | good |
| OHP sheet transparency | Good | | | | Good | | | | Good | | | |

40

TABLE 3

| | Comparative Example 1 | | | | Comparative Example 2 | | | | Comparative Example 3 | | | | Comparative Example 4 | | | |
|---|---|---|---|---|---|---|---|---|---|---|---|---|---|---|---|---|
| Inorganic particulate material/central particle diameter/added amount | Colloidal silica/40 nm/22.5 wt-% | | | | Colloidal silica/ 40 nm/1.5 wt-% | | | | Untreated silica/16 nm/2.0 wt-% | | | | Untreated silica/ 16 nm/25.0 wt-% | | | |
| Release agent (wt-%) | 7.5 | | | | 9.C | | | | 9.0 | | | | 7.0 | | | |
| Complex viscosity η* ($\times 10^2$ Pas | 24.0 | | | | 2.7 | | | | 1.7 | | | | 29.9 | | | |
| Loss tangent tan δ | 0.52 | | | | 1.68 | | | | 2.03 | | | | | | | |
| Volume-average particle diameter $D_{50}$ (μm) | 5.6 | | | | 5.2 | | | | 5.3 | | | | | | | |
| GSDv | 1.25 | | | | 1.21 | | | | 1.20 | | | | 1.26 | | | |
| GSDv/GSDp | 1.21 | | | | 1.20 | | | | 1.18 | | | | 1.27 | | | |
| Shape factor SF1 | 119.7 | | | | 117.7 | | | | 115.2 | | | | 120.4 | | | |
| Fixability(1)/peelability (2)/gloss (3)/offset resistance (4) | (1) | (2) | (3) | (4) | (1) | (2) | (3) | (4) | (1) | (2) | (3) | (4) | (1) | (2) | (3) | (4) |
| (a) Carried amount of toner 4.5 g/m$^2$ | | | | | | | | | | | | | | | | |
| Fixing temperature: | | | | | | | | | | | | | | | | |
| 1.160° C. | low | good | low | good | good | good | good | good | good | good | good | good | low | good | low | good |
| 2.180° C. | low | good | low | good | good | good | good | good | good | good | good | good | low | good | low | good |
| 3.200° C. | low | good | low | good | good | good | good | good | good | good | good | good | low | good | low | good |

TABLE 3-continued

| | Comparative Example 1 | | | | Comparative Example 2 | | | | Comparative Example 3 | | | | Comparative Example 4 | | | |
|---|---|---|---|---|---|---|---|---|---|---|---|---|---|---|---|---|
| (b) Carried amount of toner 9.0 g/m$^2$ Fixing temperature: | | | | | | | | | | | | | | | | |
| 1.160° C. | low | good | low | good | good | good | good | good | good | good | good | good | low | good | low | good |
| 2.180° C. | low | good | low | good | good | good | good | good | good | good | good | good | low | good | low | good |
| 3.200° C. | low | good | low | good | good | good | good | good | good | good | good | good | low | good | low | good |
| (c) Carried amount of toner 13.5 g/m$^2$ Fixing temperature: | | | | | | | | | | | | | | | | |
| 1.160° C. | low | good | low | good | good | low | low | good | good | low | good | good | low | good | low | good |
| 2.180° C. | low | good | low | good | good | low | low | good | good | low | good | good | low | good | low | good |
| 3.200° C. | low | good | low | good | good | low | low | good | good | low | good | good | low | good | low | good |
| OHP sheet transparency | Low | | | | Low | | | | Low | | | | Low | | | |

In the present invention, the use of the foregoing constitution makes it possible to provide a toner for the development of an electrostatic image which has a reduced dependence of the peelability of fixed sheet on the fixing temperature and the carried amount of toner and is excellent in fixing properties such as surface gloss of fixed image, OHP transparency and bending resistance of fixed image. Thus, an excellent image can be formed.

What is claimed is:

1. A toner for the development of an electrostatic image having a complex viscosity $\eta'$ of from $3.0\times10^2$ to $1.2\times10^3$ Pas at 160° C. and a loss tangent tan $\delta$ of from 0.60 to 1.60 as determined by temperature dispersion measurement method by sinusoidal oscillation method, said toner comprising:

a resin, a release agent, and an inorganic particulate material.

2. The toner for the development of an electrostatic image according to claim 1, wherein said inorganic particulate material having a central particle diameter of from 5 nm to 100 nm incorporated therein in an amount of from 2 to 20% by weight.

3. The toner for the development of an electrostatic image according to claim 1, wherein as said inorganic particulate material there is used one selected from the group consisting of silica, titanium oxide, aluminum oxide, calcium carbonate, magnesium carbonate and tricalcium phosphate.

4. The toner for the development of an electrostatic image according to claim 1 wherein said release agent incorporated therein in an amount of from 5 to 25% by weight.

5. The toner for the development of an electrostatic image according to claim 1, having a volume-average particle diameter $D_{50}$ of from 3 $\mu$m to 9 $\mu$m.

6. The toner for the development of an electrostatic image according to claim 1, having a volume-average particle size distribution index GSDv of 1.30 or less and a GSDv (volume-average particle size distribution index)/GSDp (number-average particle size distribution index) ratio of 0.95 or more.

7. The toner for the development of an electrostatic image according to claim 1, wherein the shape factor SF1 of the particulate toner is from 100 to 120.

8. The toner for the development of an electrostatic image according to claim 1, wherein the absolute value of chargeability of said toner is from 20 to 40 $\mu$C/g and the ratio of chargeability in summer environment (28° C., 85%RH) to chargeability in winter environment (10° C., 30%RH) of said toner is from 0.5 to 1.5.

9. A process for the preparation of a toner for the development of an electrostatic image according to claim 1 which comprises:

mixing a particulate resin dispersion having a particulate resin having a particle diameter of 1 $\mu$m or less dispersed therein, a colorant dispersion, a release agent dispersion and an inorganic particulate material dispersion, allowing the mixture to agglomerate to prepare a dispersion of aggregated particles, and then heating the dispersion of aggregated particles to a temperature of not lower than the glass transition point of said particulate resin to cause coalescence of particles.

10. The process for the preparation of a toner for the development of an electrostatic image according to claim 9, wherein as said inorganic particulate material dispersion there is used one having one or more selected from the group consisting of silica, titanium oxide, aluminum oxide, calcium carbonate, magnesium carbonate and tricalcium phosphate dispersed in an ionic surfactant, high molecular acid or high molecular base.

11. The process for the preparation of a toner for the development of an electrostatic image according to claim 9, which comprises:

adding a particulate resin dispersion to said dispersion of aggregated particles, stirring the mixture so that said particulate resin is attached to the surface of said aggregated particles, and then heating the material to a temperature of not lower than the glass transition point of said particulate resin to cause coalescence of particles.

12. The process for the preparation of a toner for the development of an electrostatic image according to claim 9, wherein said aggregation involves the addition of a salt of inorganic metal having a valence of two or more as a coaggulant.

13. The process for the preparation of a toner for the development of an electrostatic image according to claim 9, wherein as said metal salt there is used a tetravalent inorganic salt of aluminum.

14. An electrostatic image developer comprising a carrier and a toner, wherein as said toner there is used a toner for the development of an electrostatic image according to claim 1.

15. The electrostatic image developer according to claim 14, wherein said carrier is a resin-coated carrier.

16. A process for the formation of an image which comprises:

a step of forming an electrostatic latent image on an electrostatic carrier, a step of developing said electrostatic latent image with a developer layer on a developer carrier to form a toner image, a step of transferring said toner image onto a transferring material, and a step of fixing said toner image, wherein a toner according to claim 1 is used.

17. The process for the formation of an image according to claim 16, wherein the extra toner recovered at the step of forming a toner image is returned to said developer layer.

18. The process for the formation of an image according to claim 16, wherein said fixing step involves oilless fixing.

19. The process for the formation of an image according to claim 16, wherein the fixing rate at the fixing step is predetermined to a range of from 50 to 200 mm/sec.

* * * * *